United States Patent [19]

Hufgard

[11] Patent Number: 4,869,641

[45] Date of Patent: Sep. 26, 1989

[54] COMPRESSOR

[75] Inventor: John W. Hufgard, Novelty, Ohio

[73] Assignee: AccuSpray, Inc., Cleveland, Ohio

[21] Appl. No.: 101,690

[22] Filed: Sep. 28, 1987

[51] Int. Cl.[4] ..... F04D 29/70

[52] U.S. Cl. ..... 415/121.2; 415/177; 417/368; 384/465

[58] Field of Search ..... 415/53 R, 26, 28, 170 R, 415/198.1, 122 R, 177, 110, 111, 112, 121 G; 417/362, 368; 384/465, 135, 136

[56] References Cited

U.S. PATENT DOCUMENTS

| | | | |
|---|---|---|---|
| 633,732 | 9/1899 | PRice | 415/198.1 |
| 665,649 | 1/1901 | Winchell | 415/124 |
| 888,824 | 5/1908 | Knudsen | 384/465 |
| 1,652,873 | 12/1927 | Nolan | 417/362 |
| 2,171,248 | 8/1939 | Van Berkel | 415/121 G |
| 2,279,620 | 4/1942 | Hirschman | 417/368 |
| 2,397,012 | 3/1946 | Jepson | 415/177 |
| 2,960,937 | 11/1960 | Wright et al. | 415/199.3 |
| 2,973,894 | 3/1961 | Kimball et al. | 415/122 R |
| 3,048,006 | 8/1962 | Goodman | 415/122 R |
| 3,111,259 | 11/1963 | Demay | 417/362 |
| 3,211,363 | 10/1965 | Swanson | 415/121 G |
| 3,379,132 | 4/1968 | Wagner | 417/362 |
| 3,441,762 | 4/1969 | Luenberger et al. | 415/122 R |
| 3,606,569 | 9/1971 | Wallace | 415/198.1 |
| 3,617,149 | 11/1971 | Gibson | 415/121 G |
| 3,689,173 | 9/1972 | Morton | 415/121 G |
| 3,975,113 | 8/1976 | Ogles | 415/112 |
| 4,140,441 | 2/1979 | Patterson | 415/112 |
| 4,218,175 | 8/1980 | Carpenter | 415/2 |
| 4,478,216 | 10/1984 | Dukowski | 415/121 G |
| 4,565,488 | 1/1986 | Muck | 415/53 |
| 4,688,989 | 8/1987 | Kondo et al. | 415/113 |
| 4,729,722 | 3/1988 | Toth | 415/119 |
| 4,780,056 | 10/1988 | Toth | 417/362 |

FOREIGN PATENT DOCUMENTS

| | | | |
|---|---|---|---|
| 90549 | 8/1978 | Japan | 384/465 |
| 575305 | 10/1977 | U.S.S.R. | 415/DIG. 3 |
| 572502 | 10/1945 | United Kingdom | 417/362 |

*Primary Examiner*—Robert E. Garrett
*Assistant Examiner*—John T. Kwon
*Attorney, Agent, or Firm*—Sidney W. Millard

[57] ABSTRACT

A compressor driven by a motor delivers air under pressure to a plurality of paint spray guns. An air circulation fan is incorporated with the motor to cool the apparatus during operation. The compressor shaft includes bearings on each end and the bearing on the lower end is physically separated from the lower end of the compressor to prevent oil contamination of the air being discharged. A pump is associated with the separated bearing which delivers oil to lubricate the bearing when the compressor is in operation.

13 Claims, 3 Drawing Sheets

COMPRESSOR

FIELD OF THE INVENTION

The invention relates to an apparatus for a spray painting system involving a relatively high volume, low pressure compressor, a drive motor to power the compressor and apparatus for connecting the compressor to an air supply system connected to a plurality of spray guns.

BACKGROUND OF THE INVENTION

Compressors and more specifically centrifugal compressors, which are utilized as for example in providing the atomizing air to a spray painting system, have an inlet air supply. Atmospheric air enters an inlet plenum of a compressor and may be filtered by a relatively low pressure drop filter of the replaceable type. A filter is necessary to protect the internal parts of the compressor from damage due to dirt and particles that are present in the ambient air which may be drawn into the inlet plenum and compressor assembly.

The combination of a drive motor and a compressor where the motor drives the compressor is conventional. A conventional problem of excess heat is also created, the heat being generated by the motor and the drive mechanism between the motor and the compressor. Heat must be dissipated to the air to maintain the motor and compressor at proper operating temperatures. The compressed air will dissipate some heat from the compressor when it is operating efficiently. The heat dissipated from the machinery in general will heat and expand the air being delivered to the inlet of the compressor. This is a problem because a centrifugal compressor is inherently a constant mass machine. Thus, the greater the inlet air temperature, the greater the outlet pressure of the air of a given mass. This is a problem to be solved, namely, how to dissipate the heat while minimizing the volume of heated air delivered to the compressor inlet.

Another problem is the heat generated within the compressor during normal operations. In a spray painting system, the spray guns do not operate all the time or at a constant volume. For various reasons, the operator (be it automatic or manual) activates the spray gun for a period of time and then deactivates it as needed for the ongoing operation. A plurality of spray guns supplied from a manifold create an oscillating need for air which is inconsistent with the output from a constant output air compressor. As a result of the oscillating usage of air, there is a heat buildup in the compressor which not only inceases wear on parts, but also makes the mass output to vary and the air temperature to oscillate. Spray guns are designed to operate satisfactorily over a range of temperatures, but changing the air temperature will inherently change the spray characteristics of the paint being dispensed. Thus, there is a need to control the temperature of air in a spray painting system.

Air compressors are designed with an exterior surface to dissipate heat and at an air dispensing rate which will keep the compressor parts at a temperature within acceptable ranges. When the pressure differential from inlet to outlet is too great, the compressor temperature increases. When the back pressure at the outlet increases due to reduced usage by the spray guns, the temperature of the compressor increases for two reasons, (1) the motor has to work harder to push the air out of the housing and (2) less air passes through the compressor and thus must absorb more heat per unit of air.

BRIEF DESCRIPTION OF THE DRAWINGS

These and other aspects of the invention will be better understood by reference to the following detailed description which, when considered in conjunction with the accompanying drawings, will reveal the best mode contemplated in carrying out this invention.

DESCRIPTION OF THE PREFERRED EMBODIMENT

Figure 1:
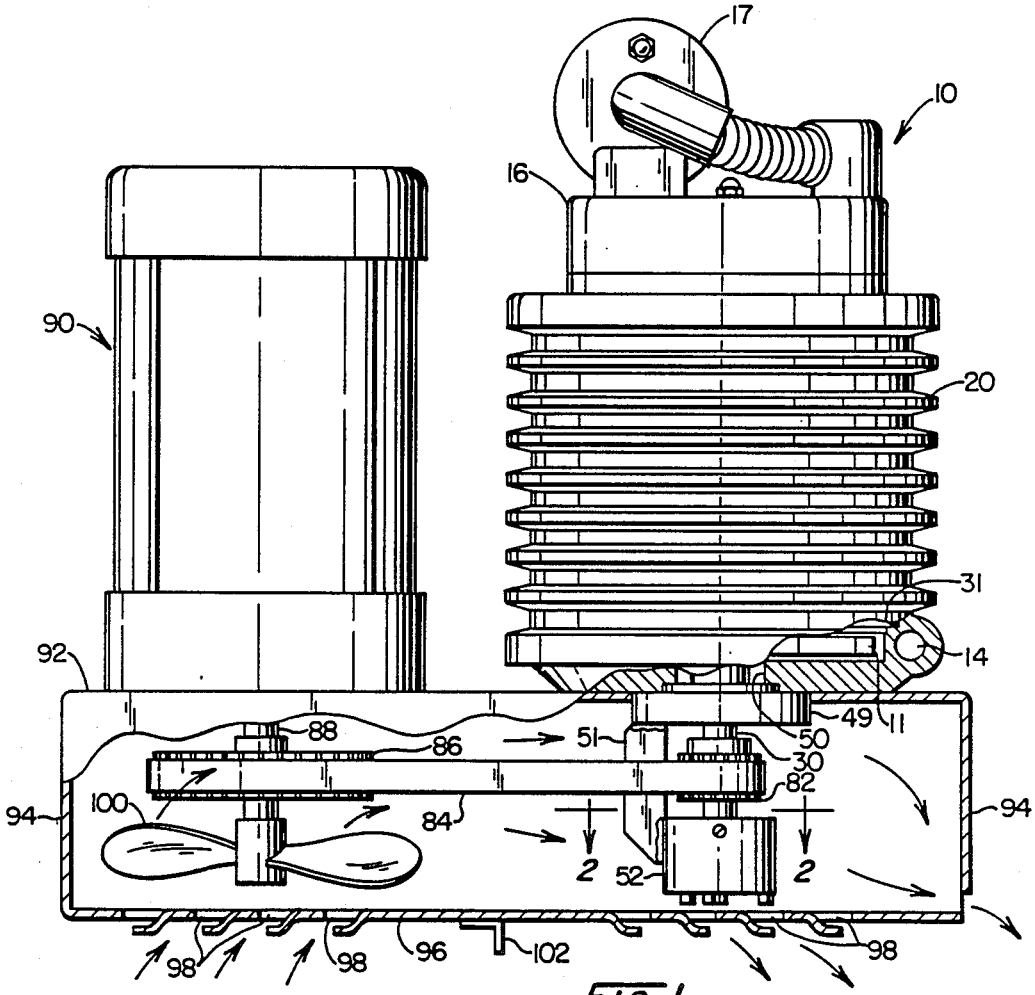
FIG. 1 is an elevational view, partially in section, of a drive motor and an air compressor mounted on a common substrate.
Figure 2:
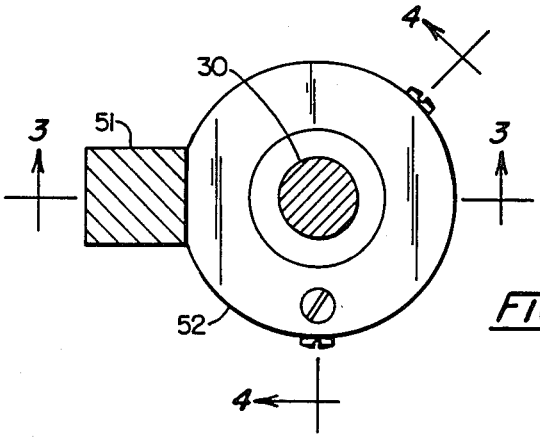
FIG. 2 is a sectional view taken along line 2—2 of FIG. 1.

With reference to the drawings, a compressor 10, preferably a five horsepower multistaged centrifugal compressor housing 20, having turbine blades 11 mounted on a shaft, an inlet 12 (best seen in FIG. 5) and an outlet 14 supplies air to a plurality of paint spray guns 15. Ambient air is drawn into an inlet plenum 16 through an air filter 17 and discharged from a compressor 20 through a duct or discharge pipe 18 for delivery to a manifold 19. The compressor body is preferably unicast aluminum; the unique casting minimizes assembly time and misalignment of rotating parts within the compressor body such as are inherent in segmented compressor bodies or where end plates are attached to each end of the casting.

Figure 5:
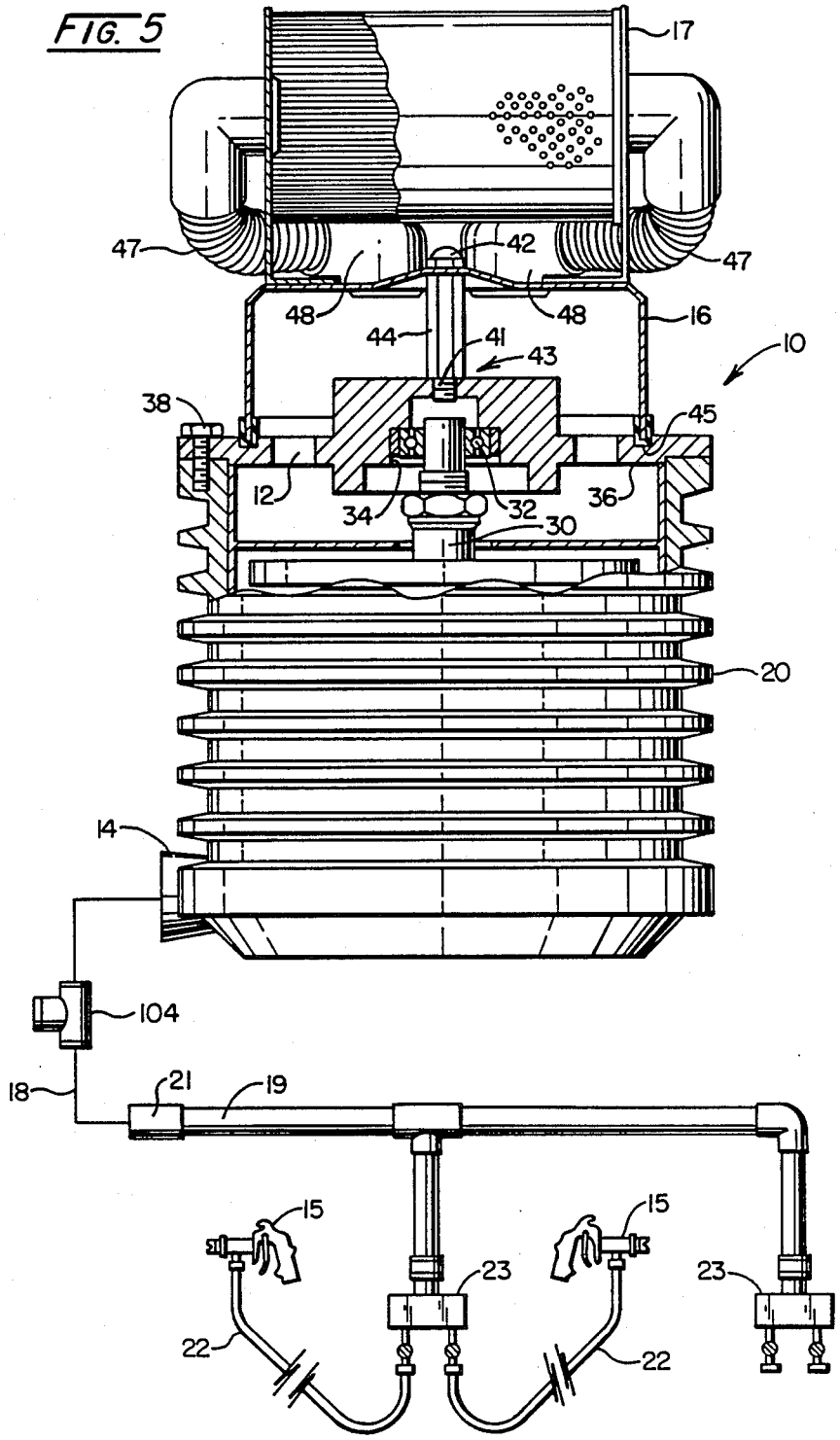
FIG. 5 is a schematic elevational view of the apparatus of FIG. 1, partially in section, showing the connection of the compressor to a manifold and spray guns.

Looking to FIG. 5, the discharge pipe 18 is connected to the manifold 19 by an adapter 21. Flexible hoses 22 connected to guns 15 are supplied by the manifold 19 through valves 23 which are independently controlled.

In a relatively dirty atmospheric environment, such as that encountered in a commercial painting facility, the use of an inlet plenum air filter 17 is an absolute necessity since dirt and foreign matter can cause extensive damage to the internal parts of a centrifugal compressor which inherently are very closely toleranced and the action of foreign materials and particles can have an immediate and disastrous effect.

FIG. 5 illustrates a shaft 30 extending the length of a bore 31 in the aluminum housing 20. The upper end of shaft 30 is frictionally inserted into a centrally located aperture 34 in an upper plate 36. The friction fit between bearing 32 and aperture 34 allows a certain amount of thermal expansion of the bearing in the aperture and has the physical characteristic of also preventing relative rotation between the juxtaposed surfaces. The fact that there is a bit of play in the system allows some self alignment of the rotating shaft.

Plate 36 is secured to the upper surface of housing 20 by a plurality of cap screws 38. The hollow casting (which forms the plenum chamber 16) is secured in air tight engagement to plate 36 by a central stud 41 and an acorn nut 42 (best seen in FIG. 5). The stud 41 projects upwardly from its attachment to plate 36 at 43 and said stud is surrounded by a cylindrical spacer 44 to keep the nut 42 from being tightened too tight and thus deforming the casting. The nut 42 also serves to clamp the lower edge of the casting into into a groove 45. A U-shaped elastomeric gasket fits around the lower edge of the casting and is drawn into fluid tight engagement with the surface of groove 45 by nut 42.

The filter 17 is mounted above the hollow casting and communicates with the plenum chamber 16 through a pair of hoses 47 and a riser 48.

At the other end of the housing 20, surrounding shaft 30, is a sealing block 49 which seals aperture 50 in the lower end of the compressor. Seal 53 prevents the escape of air between block 49 and shaft 30.

Note should be taken that the cast body 20 has an opening at its top which is of the same diameter as the bore 31, whereas the bottom opening 50 is much smaller in diameter than the bore. This minimizes the size of the pressure seal at the bottom where pressure is the greatest.

Figure 3:
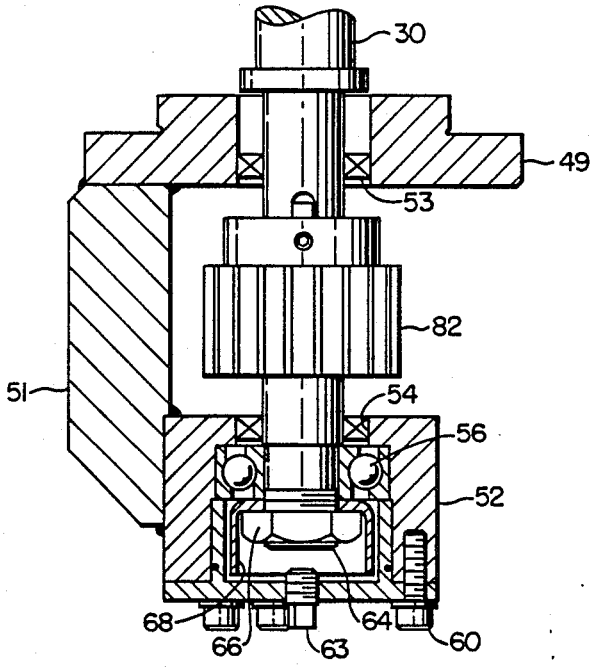
FIG. 3 is a sectional view taken along line 3—3 of FIG. 2.
Figure 4:
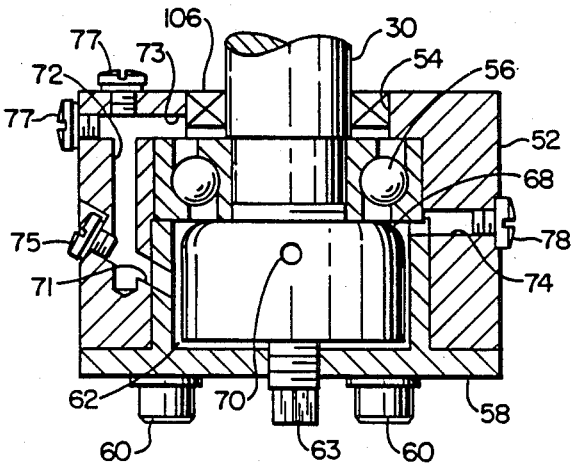
FIG. 4 is a sectional view taken along line 4—4 of FIG. 2.

A brace arm 51 is affixed to sealing block 49 and extends downward where it supports a bearing block 52 (see FIGS. 3 and 4). The shaft 30 extends into the bearing block 52 through a passage 54. A roller bearing 56 is mounted over the shaft 30 and held in the passage 54 by a cap 58 on the lower end of bearing block 52. Cap 58 is held in place by cap screws 60 to prevent the escape of lubricating oil in the lower cavity 62 formed by passage 54. A threaded plug 63 may be removed from the cap 58 to drain the oil if desired.

The lower end of shaft 30 is threaded at 64 and a nut 66 is threaded thereon to hold a dome 68 in place. A small opening 70 is formed in the upper area of the dome 68 and its function will be explained subsequently.

Bore holes 71, 72, 73 and 74 are formed in the bearing block 52 for reasons which will be explained subsequently and each bore hole is sealed by a screw 75, 77 and 78, respectively.

Intermediate seal block 49 and bearing block 52 is a pulley 82 which is mounted on the shaft 30; its function is to rotate the shaft when driven by a timing belt 84.

A closed loop is formed by the belt 84 between the smaller compressor pulley 82 and a larger pulley 86 on the lower end of a shaft 88 of a drive motor 90.

Note that the brace arm 51 extends through the closed loop to brace against side thrust of the belt 84. The belt 84 is a timing belt to further reduce the side thrust as would be inherent with a friction belt. Note further that the motor 90 and compressor housing 20 are mounted on the upper surface of a metal box 92 with their shafts 88 and 30 parallel. The sidewalls 94 of the box 92 extend downward to a bottom wall 96 which includes louvered openings 98. Enclosed within the box are the pulleys 82 and 86 and a cooling fan 100 which is mounted on the lower end of shaft 88 to draw air into the box for maintaining the apparatus at a suitable operating temperature.

Framework partially shown at 102 supports the box 92 and the framework may be on wheels (not shown) to allow easy transportation of the system from one site to another, if desired.

Looking again to FIG. 5, air from duct 18 is delivered to manifold 19 for supplying guns 15, and a thermostatically controlled valve 104 is connected between the discharge pipe and duct 18 for purposes of controlling or reducing the temperature of air in duct 18 by bleeding air from the system. When air in duct 18 reaches a predetermined temperature, in this case about 190° F., the valve opens and as air exits to the atmosphere. This results in lower back pressure and increased flow as discussed previously. While the air is below 190° F., the valve will be closed.

The operation of the system is clear from the structure described above except for the lubrication system for lubricating bearing 56. Observing FIG. 4, it will be noted that bore holes 71 and 74 extend through a part of cap 58. Therefore, the cap must be properly oriented to prevent blockage of bore holes 71 and 74. To ensure proper alignment, the hole pattern in cap 58 and bearing block 52 which receive cap screws 60 is not symmetrical. Thus, there is no way to misalign the cap.

The bearing 56 is separated from the compressor housing to prevent lubricating oil from being entrained in the air from the compressor. Oil, dirt, water and other debris entrained in air from the compressor causes an uneven finish which may not properly adhere to the surface to be painted. Thus, the filter 17 and the spaced apart bearing 56 are structurally located to minimize contamination of the air being compressed.

A unique lubricating pump is provided in bearing block 52. It is desired to fill the lower portion of passage 54 with oil to a specific depth. Specifically, it is not desirable to have the bearing 56 immersed in oil. This filling operation is accomplished by first removing screws 77 and 78. Then, oil is injected into passage 73 and it will collect in the reservoir 62 above cap 58 until it overflows through bore hole 74. At that point, the oil resevoir is full and screws 77 and 78 may be replaced.

It may be that screw 77 could be removed to allow oil to be injected through bore hole 72, but the orientation of the various elements of the system make this difficult. Thus, oil is preferably injected through bore hole 73.

To prevent an air bubble inside dome 68, the hole 70 is provided. Thus, as oil rises, air can escape through hole 70 and bore hole 74.

In operation, the dome 68 will spin with the shaft 30. That forces the oil radially outward through bore hole 71, upward through bore hole 72 and then radially inward through bore hole 73 where it will trickle down over bearing 56 and return by gravity to the reservoir 62. A seal 106 between the shaft 30 and bearing block 52 prevents the escape of oil in the upward direction.

Having thus described the invention in its preferred embodiment, it will be clear that modifications may be made to the structure without departing from the spirit of the invention. Accordingly, it is not intended that the drawings nor the words used to describe the same be limiting on the invention. Rather, it is intended that the invention be limited only by the scope of the appended claims.

Having thus described this invention, what is claimed is:

1. A combination for compressing air including means forming a turbine housing having a cylindrical bore, the exterior of said housing means including circumferentially extending ribs, said bore having upper and lower ends, means forming a first opening through the housing at the upper end of the bore and means forming a second opening through the housing at the lower end of said bore, a shaft coaxially extending the full length of said bore, a plurality of turbine blades mounted on said shaft within said bore, the housing means being of one piece of metal, a radially disposed outlet through said housing means for the exit of compressed air from said bore, a bearing on each end of said shaft, and a drive motor adjacent said housing means, the means forming the second opening being of a cross-sectional area less than the cross-sectional area of the cylindrical bore, the means forming the first opening being of the same cross-sectional area as the bore, a lower metallic block sealingly engages the surface of the housing means and the shaft at said means forming said second opening and prevents the escape of air from said bore, a pulley being mounted on said shaft below said block, said drive motor including a shaft with a pulley mounted on one end of said motor shaft, a drive belt extending around the two pulleys to form a closed loop, a brace arm being attached to said lower block and extending downward through said loop, another bearing block being secured to the lower end of said arm, one of said bearings being mounted over said compressor shaft and supported in said another bearing block, metallic plate secured over said means forming the first opening, the plate including a plurality of aperture, the first of said apertures in said plate being concentrically disposed over said shaft, the other of said bearings being seated in said first aperture and around said shaft, means forming a plenum chamber in fluid tight engagement with said metallic plate, another of said apertures in said plate being disposed radially outward of said first aperture for admitting air from said plenum chamber into said compressor, means forming an air filter enclosure on the exterior of the housing and adjacent said plenum chamber and means for transferring air from the air filter enclosure means into the plenum chamber.

2. The combination of claim 1 wherein the bearing block includes pump means for lubricating the bearing mounted in the bearing block.

3. The combination of claim 2 wherein the pump comprises (1) means forming a passage extending from an inlet below the bearing mounted in the bearing block to an outlet above the bearing block and (2) means mounted on said compressor shaft for forcing oil through said passage means from the passage means inlet to its outlet; the at rest level of said oil being below the bearing mounted in said another bearing block.

4. The combination of claim 3 wherein the housing is a one piece structure of cast aluminum.

5. The combination of claim 4 including a fan mounted on the drive motor shaft to blow air on the motor for cooling purposes.

6. The combination of claim 5 wherein the drive motor and compressor housing are mounted on the upper surface of a hollow support box with the compressor and motor shafts being parallel, the box including a top, sides and a bottom with a plurality of openings to allow the free circulation of air, the fan being enclosed within the box to draw air into the box and expell air from the box.

7. The combination of claim 1 including a fan mounted on the drive motor shaft to blow air on the motor for cooling purposes.

8. The combination of claim 7 wherein the drive motor and compressor housing are mounted on the upper surface of a hollow support box with the compressor and motor shafts being parallel, the box including a top, sides and a bottom with a plurality of openings to allow the free circulation of air, the fan being enclosed within the box to draw air into the box and expell air from the box.

9. The combination of claim 1 wherein the pump comprises (1) means forming a passage extending from an inlet below the bearing mounted in the bearing block to an outlet above the bearing block and (2) means mounted on said compressor shaft for forcing oil through said passage means from the passage means inlet to its outlet; the at rest level of said oil being below the bearing mounted in said bearing block.

10. A combination for compressing air including a turbine housing having inlet and outlet ends, said housing having a cylindrical bore with a shaft extending coaxially through the bore, a plurality of turbine blades mounted on said shaft within said bore and an outlet opening extending from said bore to receive the discharge of air compressed within the turbine, a brace arm extending from the outlet end of the turbine and mechanically attached thereto, a bearing block secured to one end of the brace arm remote from the turbine housing, a bearing mounted in said bearing block and surrounding one end of said shaft, a filter being in fluid communication with the inlet end of the turbine to supply clean air to be compressed, said filter being configured to prevent air from entering the turbine housing until it has passed through the filter, the bearing block including a pump means for lubricating the bearing mounted in the bearing block, said pump comprising (1) means forming a passage extending from an inlet below the bearing mounted in the bearing block to an outlet above the bearing block, and (2) means mounted on said compressor shaft for forcing oil through said passage means from the passage means inlet to its outlet; the at rest level of said oil being below the bearing mounted in said bearing block.

11. The combination of claim 10 wherein the turbine housing is a one piece structure of cast aluminum.

12. The combination of claim 11 including a drive motor adjacent the turbine housing and both being mounted on the upper surface of a hollow support box with the turbine and motor shafts being parallel, the box including a top, sides and a bottom with a plurality of openings to allow the free circulation of air, a fan being mounted on the shaft of the drive motor and enclosed within the box to draw air into the box and expel air from the box to assist in cooling the drive motor and the turbine.

13. The combination of claim 10 including a drive motor adjacent the turbine housing and both being mounted on the upper surface of a hollow support box with the turbine and motor shafts being parallel, the box including a top, sides and a bottom with a plurality of openings to allow the free circulation of air, a fan being mounted on the shaft of the drive motor and enclosed within the box to draw air into the box and expel air from the box to assist in cooling the drive motor and the turbine.

* * * * *